US005733058A

United States Patent [19]

Hofmann

[11] Patent Number: 5,733,058

[45] Date of Patent: Mar. 31, 1998

[54] DISPENSING CONTAINER FOR A COMPACT PRODUCT

[75] Inventor: Richard Hofmann, Chicago, Ill.

[73] Assignee: Blistex Inc., Oak Brook, Ill.

[21] Appl. No.: 676,020

[22] Filed: Sep. 16, 1996

[51] Int. Cl.[6] ..... A45D 40/06

[52] U.S. Cl. ..... 401/70; 401/68; 401/87; 401/175

[58] Field of Search ..... 401/70, 87, 68, 401/75, 79, 175

[56] References Cited

U.S. PATENT DOCUMENTS

| | | | |
|---|---|---|---|
| 2,818,167 | 12/1957 | McKinley | 401/753 |
| 3,589,821 | 6/1971 | Barney et al. | 401/75 |
| 3,907,441 | 9/1975 | Ipec et al. | 401/75 |
| 4,605,330 | 8/1986 | Crowley et al. . | |
| 4,615,632 | 10/1986 | Iwamoto et al. . | |
| 4,770,556 | 9/1988 | Ackerman et al. . | |
| 4,954,000 | 9/1990 | Gueret . | |
| 5,401,112 | 3/1995 | Dornbusch et al. . | |
| 5,437,513 | 8/1995 | Favre . | |

*Primary Examiner*—Steven A. Bratlie
*Attorney, Agent, or Firm*—Brezina & Ehrlich

[57] ABSTRACT

A container for a compact product including a housing, a stem, and a follower engaged with the stem adapted to move axially within the container in response to rotation of the stem. The follower including a central tube threadingly engaged with the stem that is adapted to flex when the follower is in a retracted position and the stem is rotated, to permit the stem to rotate relative to the follower. A finger-wheel may be included to facilitate rotation of the stem.

23 Claims, 1 Drawing Sheet

DISPENSING CONTAINER FOR A COMPACT PRODUCT

The present invention relates to a dispensing container for a compact product, such as lip balm, lipstick, other lip care product, deodorant, sun screen, skin moisturizer or the like.

BACKGROUND

Various types of containers for a compact product, such as lip balm, lipstick, deodorant or the like, are known in the art. One known device, for example, includes a housing having an open end, a threaded stem, a fingerwheel mounted to the stem for rotating the stem, and a follower threadingly engaged with the stem that is adapted to move axially within the container in response to twisting of the fingerwheel. The follower is adapted to slide between a retracted position and a dispensing position. Manually turning or twisting the fingerwheel in a first direction causes the follower to act as a plunger and push a leading end of the compact product out of the open end of the housing for application. Turning the fingerwheel in a second direction (i.e., the reverse direction) causes the follower to move axially in a rearward direction toward the retracted position and to pull the leading end of the compact material inside the housing.

One problem associated with this known device is that it can become inoperative if the follower is in its retracted position and the fingerwheel is turned in the second direction. Because the follower is unable to move further, the further turning of the fingerwheel can cause the stem, the follower, or any of the threads of the stem or follower to strip or fracture or can otherwise cause the container to become inoperative.

This problem can arise, for example, during a first use of the container since sticking of the compact product to the housing tends to occur prior to first use and since, as a result, an increased twisting force is usually necessary to turn the follower. If the increased twisting force is exerted in the wrong direction, it will likely cause the container to become inoperative.

The above-described problem is not limited to first use of the container for a compact product. To the contrary, this problem can arise any time the fingerwheel is turned in the wrong direction with a sufficient twisting force when the follower is in the retracted position.

Accordingly, it is an object of the present invention to provide a dispensing container that addresses the above-described problem.

SUMMARY

In accordance with a preferred embodiment of the invention, a container for a compact product is provided that includes a housing with an open end, an externally-threaded stem, and a follower threadingly engaged with the stem. The follower is adapted to move from a retracted position to a dispensing position when the stem is rotated in a first direction and from the dispensing position to the retracted position when the stem is rotated in a second direction. The follower is adapted to deform or flex to permit at least a portion of one or more external threads of the stem to slide or ride over at least a portion of one or more internal threads of the follower when the follower is in the retracted position and the stem is rotated in the second direction.

The follower preferably includes an internally-threaded central barrel or tube in threading engagement with the stem, an outer casing, and a flexible web preferably extending from the casing to a base of the tube. The flexible web preferably is generally circular and extends at an angle towards the open end of the housing. The web may include an area of reduced thickness that may be circular and may surround the base of the tube. The thickness of the wall defining the tube preferably is relatively thin. In a preferred embodiment, the thickness of the wall is substantially equal to or less than the thickness of the one or more threads defined on the tube and is less than the thickness of the web area of reduced thickness.

The stem preferably includes a plurality of external threads along most of its length and defines at least one unthreaded portion to facilitate flexing of the tube. In a preferred embodiment, a pair of diametrically-opposed unthreaded portions are defined on the stem, each unthreaded portion being located between a pair of diametrically-opposed threaded portions. A rotatable fingerwheel may be rigidly mounted to the stem at the bottom of the housing to facilitate manual rotation of the stem. Additionally, a cap may be included to enclose the open end of the housing.

Accordingly, the present invention provides a container that does not break or otherwise become inoperative in the event that the stem is rotated in the wrong direction when the follower is in its retracted position. Instead, the container in accordance with a preferred embodiment of the invention enables the tube or other portion of the follower to flex and ride over the threaded stem and thereby avoids breakage or stripping of the stem, follower, or any of the threads on the stem or follower.

The present invention and the advantages thereof will become more apparent upon consideration of the following detailed description when taken in conjunction with the accompanying drawings.

DETAILED DESCRIPTION OF THE PREFERRED EMBODIMENTS

Figure 1:
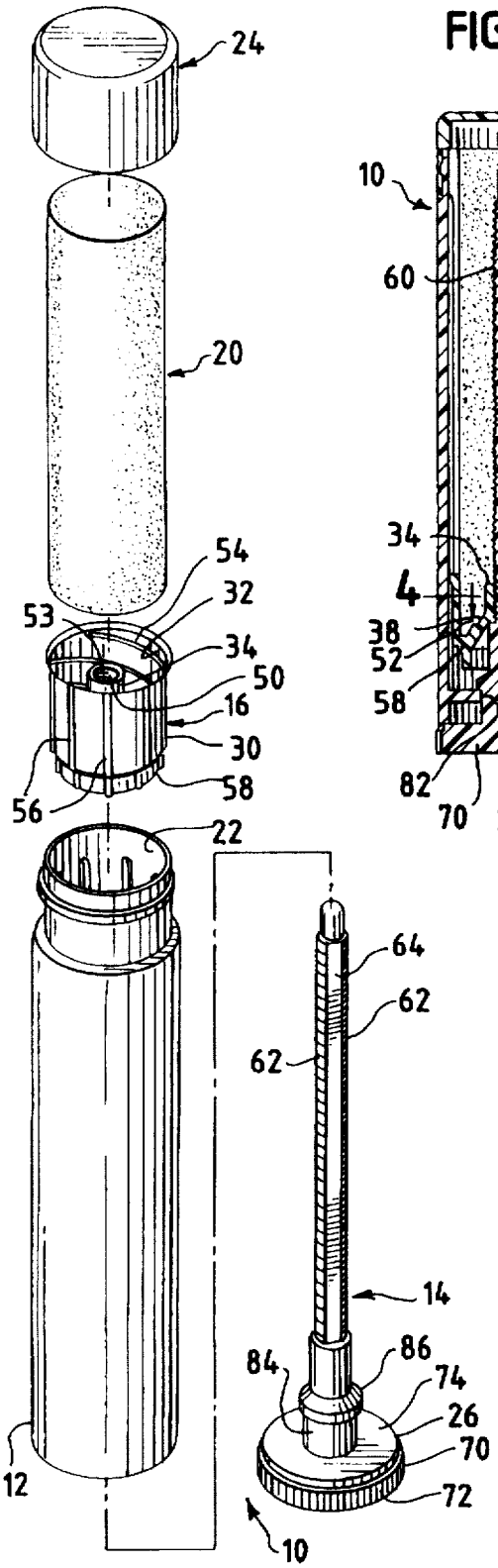
FIG. 1 is an exploded view of a dispensing container for a compact product in accordance with a preferred embodiment of the invention, also illustrating the compact product.

A dispensing container 10 in accordance with a preferred embodiment of the invention is illustrated in FIGS. 1–5 as comprising a generally tubular and substantially cylindrical housing 12, an externally-threaded stem 14, and a follower 16 in threading engagement with the stem. The housing 12 is adapted to house a compact product 20, such as lip balm, lip stick, other lip care product, deodorant, sun screen, skin moisturizer or the like, and includes at least one open end 22 for dispensing the product. A cap 24 may be included to enclose the open end 22 of the housing 12 and to protect or shield the compact product 20 before and after application of the compact product. A rotatable fingerwheel 26 may be mounted to the stem to facilitate manual rotation of the stem.

When the fingerwheel 26 is twisted or turned in a first direction (e.g., counter clockwise in the illustrated embodiment when looking into the open end 22 of the housing 12), the threaded stem 14 rotates in the first direction which causes the follower 16 to slide axially within the housing from a retracted position towards a dispensing position (i.e., towards the open end 22 of the housing 12). The follower 16, in turn, pushes a leading end of the compact product 20 out of the housing 12 for dispensing of the product. After the compact product 20 has been applied, the fingerwheel 26 can be twisted in a second direction (e.g., clockwise in the illustrated embodiment when looking into the open end 22 of the housing 12), which causes the follower 16 to slide axially in a reverse direction away from the open end 22 of the housing 12. The follower, in turn, pulls the compact product 20 inwardly.

In a preferred embodiment, the follower 16 includes a substantially cylindrical and generally tubular casing 30 that defines an open end 32, an internally-thread tube or barrel 34 that is coaxial with the casing, and a flexible web 36 that interconnects the casing and the tube, preferably at a base 38 of the tube. The internally-threaded tube 34 may be internally threaded in any suitable manner. In a preferred embodiment, for example, the tube 34 includes a triple screw thread 50 extending along substantially the length of the tube. The triple screw thread increases the travel distance of the casing 30 in response to rotation of the stem 14.

The web 36 preferably extends from the casing 30 at an angle A towards the open end 32 of the casing. In a preferred embodiment, the angle A, as measured between a bottom surface of the web 36 and the casing, is in the range of about 110 to 130 degrees relative to the casing 30, and desirably about 120 degrees. The web 36 may also include an area of reduced thickness 52 to further facilitate flexing of the tube. In the illustrated embodiment, the area of reduced thickness 52 is circular and surrounds the base 38 of the tube 34.

The wall 53 of the tube 34 is preferably relatively thin to facilitate flexing of the tube. In a preferred embodiment, the wall is thinner than the thread 50 and the area of reduced thickness 52 of the web. Desirably, the thickness of the thread 50 of the tube 34 gradually decreases as the thread extends radially inward (see FIG. 3), and the thickness of the wall 53 of the tube 34 is substantially equal to or less than the thickness of the thread at its distal end.

If desired, an internal thread 54 may be included on the casing 30 to engage the compact product 20, and external ribs 56 may be included on the casing to prevent rotation of the casing 30 relative to the housing 12 during rotation of the stem 14. The casing 30 may include a bottom portion 58 of reduced outer diameter.

Figure 4:
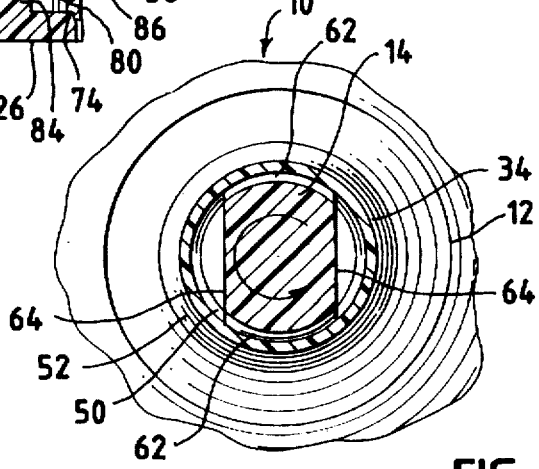
FIG. 4 is an enlarged view taken along the lines 4—4 of FIG. 2, illustrating a tube or barrel of the follower in an unflexed state.
Figure 5:
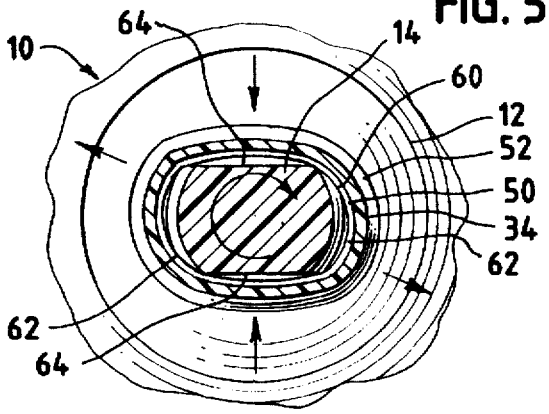
FIG. 5 is a view similar to FIG. 4, illustrating the tube or barrel in a flexed state.

In a preferred embodiment, the stem 14 includes a plurality of threads 60 along most of the length of the stem that define first and second threaded portions 62 engageable with the internally-threaded tube 34, and first and second unthreaded portions 64, which also facilitate flexing of the tube 34 (see e.g., FIGS. 4 and 5). In the illustrated embodiment, the threaded and unthreaded portions 62, 64 are defined along most of the length of the stem 14; the first and second threaded portions 62 are diametrically opposed from each other; and the first and second unthreaded portions 64 are diametrically opposed from each other.

The fingerwheel 26 may be mounted to the stem 14 in any suitable manner that permits manual twisting of the fingerwheel and rotation of the stem 14. The fingerwheel 26 may, for example, be integral or unitary with a base of the stem. The fingerwheel 26 is preferably engaged with the bottom of the housing 12 in a manner such that the fingerwheel can rotate relative to the housing. The illustrated fingerwheel 26 includes a disk 70 with a gripping surface 72, and a mounting disk 74 that is integral or unitary with the bottom of the stem. An annular recess is defined at the bottom of the housing 12 for receiving the mounting disk 74.

Figure 2:
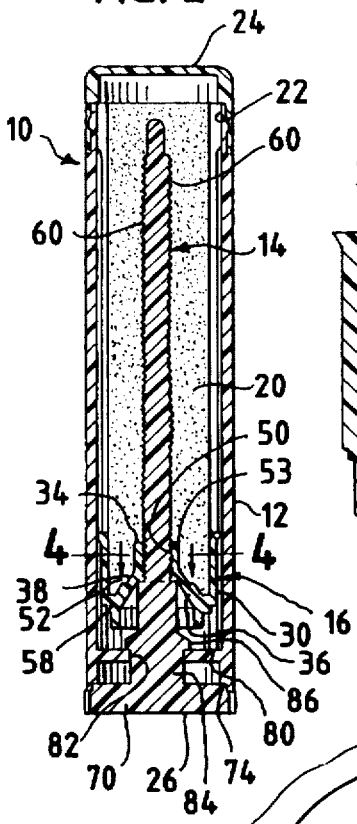
FIG. 2 is a cross section of the dispensing container of FIG. 1 taken along its longitudinal axis.
Figure 3:
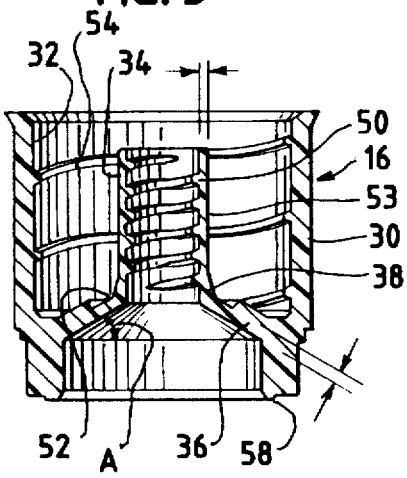
FIG. 3 is a cross section of the follower of the dispensing container of FIGS. 1 and 2 taken along its longitudinal axis.

An integral plate 80 or other suitable structure may be included between the fingerwheel 26 and the web 36 of the follower 16 for joining the fingerwheel 26 to the housing 12. The plate 80 preferably defines an aperture 82 to receive the stem 14. If desired, the plate 80 may extend at an upward angle to complement the configuration of the bottom of the web 36. The plate 80 and stem desirably are configured to prevent the stem from moving axially. The stem 14 may include an integral or unitary sleeve 84 with a shoulder 86 for engaging the plate 80, as illustrated in FIG. 2.

The invention in accordance with a preferred embodiment of the invention operates as follows. During normal operation, the tube 34 is in its unflexed state (see FIG. 4), and the follower 16 can be moved axially in the desired direction by rotating the stem 14 (by the fingerwheel 26 or the like) in the desired direction. By rotating the stem 14 in the first direction, the follower travels toward the open end 22 of the housing 12, and by rotating the stem in the second direction the follower travels toward the retracted position.

In accordance with a preferred embodiment of the present invention, when the follower is in its retracted position, the stem 14 can be rotated in the second direction without breaking the stem or the follower (or any of the threads). Instead, the tube is adapted to flex (as shown in FIG. 5) to permit the threads 60 of the stem 14 located within the tube 34 to slide or ride over the thread 50 of the tube. As a result, the stem 14 can be rotated relative to the follower 16 when the follower is in its retracted position without causing the container 10 to become inoperative.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A dispensing container for a compact product comprising:

(a) a substantially tubular housing defining an axis;

(b) an externally-threaded stem;

(c) a follower disposed within the housing including an internally-threaded tube engageable with the stem, the follower adapted to move from a retracted position toward a dispensing position when the stem is rotated in a first direction and from the dispensing position toward the retracted position when the stem is rotated in a second direction, at least a portion of the tube being adapted to flex to permit at least a portion of an external thread of the stem to slide over at least a portion of an internal thread of the tube when the follower is in the retracted position and the stem is twisted in the second direction.

2. The dispensing container of claim 1 wherein the follower further includes a casing and a web joining the tube and casing, the web being flexible to facilitate flexing of said portion of the tube.

3. The dispensing container of claim 2 wherein the web is joined to a base of the tube and includes an area of reduced thickness adjacent the base.

4. The dispensing container of claim 3 wherein the area of reduced thickness is circular and surrounds the base of the tube.

5. The dispensing container of claim 3 wherein the tube is defined by a generally cylindrical wall, the thickness of the wall being less than the thickness of the area of reduced thickness.

6. The dispensing container of claim 2 wherein the housing has an open end and a bottom surface of the web extends from the casing to the tube at an angle toward the open end, the angle being in the range of about 110 to 130 degrees relative to the casing.

7. The dispensing container of claim 6 wherein the angle is about 120 degrees.

8. The dispensing container of claim 2 wherein the casing is generally cylindrical and the casing and the tube are co-axial.

9. The dispensing container of claim 1 wherein the tube is defined by a generally cylindrical wall and at least one internal thread, the thickness of the wall being approximately equal to the thickness of the thread.

10. The dispensing container of claim 1 wherein the tube is defined by a generally cylindrical wall and at least one internal thread, the thickness of the wall being less than the thickness of the thread.

11. The dispensing container of claim 1 wherein the stem includes a plurality of external threads along most of the length of the stem.

12. The dispensing container of claim 11 wherein the stem defines at least one unthreaded portion adapted to be received by the tube to facilitate flexing of said portion of the tube.

13. The dispensing container of claim 12 wherein there are two unthreaded portions.

14. The dispensing container of claim 13 wherein the two unthreaded portions are diametrically opposed from each other relative to the stem.

15. The dispensing container of claim 13 wherein the unthreaded portions extend along most of the length of the stem.

16. The dispensing container of claim 1 wherein the stem defines a pair of longitudinally-extending and diametrically-opposed threaded portions and a pair of longitudinally extending and diametrically-opposed unthreaded portions to facilitate flexing of said portion of the tube.

17. The dispensing container of claim 1 further comprising a fingerwheel rigidly mounted to the stem adapted to facilitate rotation of the stem.

18. A dispensing container for a compact product:

(a) a generally cylindrical container having an open end;

(b) a stem disposed substantially within the container, the stem including a plurality of external threads; and (c) a follower disposed within the container adapted to slide from a retracted position toward a dispensing position when the stem is rotated in a first direction and from the dispensing position toward the retracted position when the stem is rotated in a second direction, the follower including;

(i) a generally cylindrical casing;

(ii) a generally cylindrical tube threadingly engaged with the stem, the tube having a base and including at least one internal thread, at least a portion of the tube adapted to flex to permit at least one of the external threads of the stem to slide over at least a portion of the internal thread when the follower is in the retracted position and the stem is twisted in the second direction; and (iii) a flexible web interconnecting the base of the tube and the casing to facilitate flexing of said portion of the tube, the web having a bottom surface extending toward the open end at an angle in the range of about 110 to 130 degrees relative to the casing, the web including a circular area of reduced thickness that surrounds the base of the tube.

19. The dispensing container of claim 18 wherein the stem includes first and second unthreaded portions adapted to facilitate flexing of said portion of the tube.

20. The dispensing container of claim 19 wherein the first and second unthreaded portions extend along most of the length of the stem and into the tube.

21. The dispensing container of claim 20 wherein the first and second unthreaded portions are diametrically opposed relative to the stem.

22. The dispensing container of claim 18 wherein the stem defines a pair of longitudinally-extending and diametrically-opposed threaded portions and a pair of longitudinally-extending and diametrically-opposed unthreaded portions to facilitate flexing of said portion of the tube.

23. The dispensing container of claim 18 further comprising a fingerwheel rigidly mounted to the stem adopted to facilitate rotation of the stem.

* * * * *